US008577239B2

(12) United States Patent
Nishisaka et al.

(10) Patent No.: US 8,577,239 B2
(45) Date of Patent: Nov. 5, 2013

(54) IMAGE FORMING APPARATUS

(75) Inventors: Yusuke Nishisaka, Tokyo (JP); Hideo Yamaki, Tokyo (JP); Shigetaka Kurosu, Tokyo (JP); Hiroshi Morimoto, Tokyo (JP); Satoshi Nishida, Saitama (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 209 days.

(21) Appl. No.: 13/301,890

(22) Filed: Nov. 22, 2011

(65) Prior Publication Data

US 2012/0134698 A1 May 31, 2012

(30) Foreign Application Priority Data

Nov. 26, 2010 (JP) ..... 2010-263288

(51) Int. Cl.
*G03G 15/00* (2006.01)

(52) U.S. Cl.
USPC ..... 399/71

(58) Field of Classification Search
USPC ..... 399/71, 350, 351
See application file for complete search history.

(56) References Cited

U.S. PATENT DOCUMENTS

| | | | | |
|---|---|---|---|---|
| 7,120,376 | B2 * | 10/2006 | Saito et al. | 399/167 |
| 7,738,807 | B2 * | 6/2010 | Inada et al. | 399/71 |
| 2008/0008490 | A1 * | 1/2008 | Sanmonji | 399/71 |
| 2011/0150519 | A1 * | 6/2011 | Kanazawa et al. | 399/71 |

FOREIGN PATENT DOCUMENTS

| | | |
|---|---|---|
| JP | 2002-311771 | 10/2002 |
| JP | 2005-031431 | 2/2005 |
| JP | 2007-328088 | 12/2007 |

* cited by examiner

*Primary Examiner* — David Gray
*Assistant Examiner* — Gregory H Curran
(74) *Attorney, Agent, or Firm* — Lucas & Mercanti, LLP

(57) ABSTRACT

An image forming apparatus including a transfer section for transferring a toner image formed on an image bearing member onto a sheet by pressure contact of the sheet against the image bearing member with a transfer member; a cleaning section having a cleaning blade to remove residual toner on the image bearing member; and a control section for controlling a rotation of the image bearing member so as to carry out a return action of a blade configuration which stops or reverses the rotation of the image bearing member, when the rotation amount reaches a predetermined value, wherein the control section additionally carries out the return action when the rotation amount reaches a value smaller than the predetermined value, in a case where a size of a sheet in a current job is larger than a size a sheet having been passed through in a previous job.

4 Claims, 9 Drawing Sheets

IMAGE FORMING APPARATUS

RELATED APPLICATION

This application is based on Japanese Patent Application No. 2010-263288 filed on Nov. 26, 2010 in Japan Patent Office, the entire content of which is hereby incorporated by reference.

TECHNICAL FIELD

The present invention relates to an image forming apparatus comprising a cleaning device which cleans the surface of an image bearing member by bringing a blade into close contact with the surface.

BACKGROUND ART

In general, in a cleaning device used for an image forming apparatus, the major method has been that toner on an image bearing member is removed by continuously bringing a blade made of a material such as urethane rubber into close contact with the image bearing member. In this method, it has been known that foreign matter such as paper powder is caught at the pointed end of a blade whereby the lip of the blade or cleaning failure is caused. As a countermeasure against the problem, there is disclosed in Patent Documents 1 to 3 as shown below a method in which, to remove foreign matter from the pointed end of a blade, an image forming job being run is interrupted to stop the movement of an image bearing member or to rotate it in the reverse direction.

The image forming apparatus described in Japanese Patent Application Publication No. 2002-311771 is provided with a cleaning action of a blade in which a photoreceptor is rotated in the opposite direction to the direction at the time of image formation, and carries out the cleaning action at every prescribed interval of the number of image formation to make it possible to maintain excellent cleaning properties over a long period of time. The prescribed interval is selected based on the number of cartridges used or environmental conditions (temperature or humidity).

The image forming apparatus described in Japanese Patent Application Publication No. 2005-31431 has a cleaning action of a blade in which the apparatus controls a photoreceptor driving motor to stop the photoreceptor, rotate it in the reverse direction and then rotate it in the normal direction during job operations of continuous printing, and returns to the original continuous printing job, and thereby repeats the cleaning action of a blade in a unit of the number of prescribed printing to prevent accumulation of paper powder at an edge of the blade, and to decrease printing failure and improve reliability.

Further, in the image forming apparatus described in Japanese Patent Application Publication No. 2007-328088, a cleaning action of a blade is repeated in which the direction of rotation of the photoreceptor is reversed at every prescribed number of rotations in accordance with the number of rotations of the photoreceptor.

However, it was found that cleaning failure on the image bearing member cannot be sufficiently prevented, in the image forming apparatus comprising a cleaning means which cleans the surface of an image bearing member by bringing a cleaning blade into close contact with the image bearing member, and a transfer means which transfers electrostatically a toner image on the image bearing member onto a sheet of paper using a transfer member on which a bias voltage was applied and a lubricant was applied, even if the technology described in Patent Documents 1 to 3, that is, the cleaning action of a blade in which, to remove foreign matter such as paper powder from the blade, a printing job is interrupted during an operation of continuous printing job at every prescribed interval to stop an image bearing member or to rotate it in the reverse direction is carried out.

This problem is one in which, in the case where large size printing jobs are continually carried out after small size printing jobs were continually carried out, a cleaning failure occurs on both side areas in the main scanning direction of a large size sheet of paper before reaching the above prescribed interval, that is, before carrying out the cleaning action of the cleaning blade.

The object of the present invention is to provide an image forming apparatus capable of preventing cleaning failure which occurs on both side areas in the main scanning direction of a large size sheet of paper in the case where large size printing jobs are continually carried out after small size printing jobs were continually carried out.

SUMMARY

To achieve the abovementioned object, image forming apparatuses reflecting one aspect of the present invention can be attained by the image forming apparatuses described as follows.

Item 1. An image forming apparatus comprising: an image forming section for forming a toner image on an image bearing member; a transfer section for transferring a toner image formed on the image bearing member onto a sheet of paper by pressure contact of the sheet of paper against the image bearing member with the transfer member, wherein the transfer section includes a lubricant applying section applying a lubricant to a transfer member; a cleaning section being disposed downstream of the transfer section in a rotating direction of the image bearing member and removes residual toner on the image bearing member with a cleaning blade; and a control section for controlling a rotation of the image bearing member so as to carry out a return action of a blade configuration which stops or reverses the rotation of the image bearing member, when a rotation amount of the image bearing member which continuously rotates reaches a first predetermined value, wherein the control section additionally carries out the return action of the blade configuration when the rotation amount of the image bearing member reaches a second predetermined value which is smaller than the first predetermined value, in a case where a size in a main scanning direction of a sheet being passed through in a current printing job is larger than a size in the main scanning direction of a sheet of paper having been passed through in a previous printing job which was carried out just before the current printing job.

Item 2. The image forming apparatus described in claim 1, wherein the second predetermined value is set based on minimum ratio Dmin of sheet passed among ratios D of sheet passed which was calculated using the following formula at each area in which a sheet passed area, through which sheets are passed at the current printing job, is divided in the main scanning direction, $$D=L_p/L_a,$$

where $L_a$ is a rotated distance of the image bearing member which rotated in a predetermined period in the previous printing job, and $L_p$ is a cumulative total length in a sub-scanning direction of the total sheets having been passed through during the predetermined period.

Item 3. The image forming apparatus described in claim 1, wherein the second predetermined value is set based on a rotated amount of the image bearing member which rotated at the previous printing job just before the current printing job.

Item 4. The image forming apparatus described in claim 1, wherein the second predetermined value is set based on maximum corrected rotated distance Φmax among corrected rotated distances Φ which is calculated using the following formula at each area in which a sheet passed area, through which sheets are passed at the current printing job, is divided in the main scanning direction, $$\Phi=\Sigma\Phi_i \quad \text{Formula (1)}$$

$$\Phi_i=\alpha\times L_1+\beta\times L_2 \quad \text{Formula (2)}$$

wherein, $\alpha<0$; $\beta>0$; Φ is the corrected rotated distance of the image bearing member in which calculated values $\Phi_i$ calculated by using Formula (2) were summed up on a total sheets (from i=1 to i=N) having been passed through in a predetermined period $T_a$ in the previous printing job; $L_1$ is a length in a sub-scanning direction of each sheet (the i-th sheet) having been passed through; and $L_2$ is a length in the sub-scanning direction of a non-sheet area produced between sheets having been passed through.

DETAILED DESCRIPTION OF PREFERRED EMBODIMENTS

Hereinafter embodiments of the present invention will be described. The technical scope of the claims or meanings of the terms are not limited by the descriptions in this section.

<<Image Forming Apparatus of Electrophotographic System>>

Figure 1:
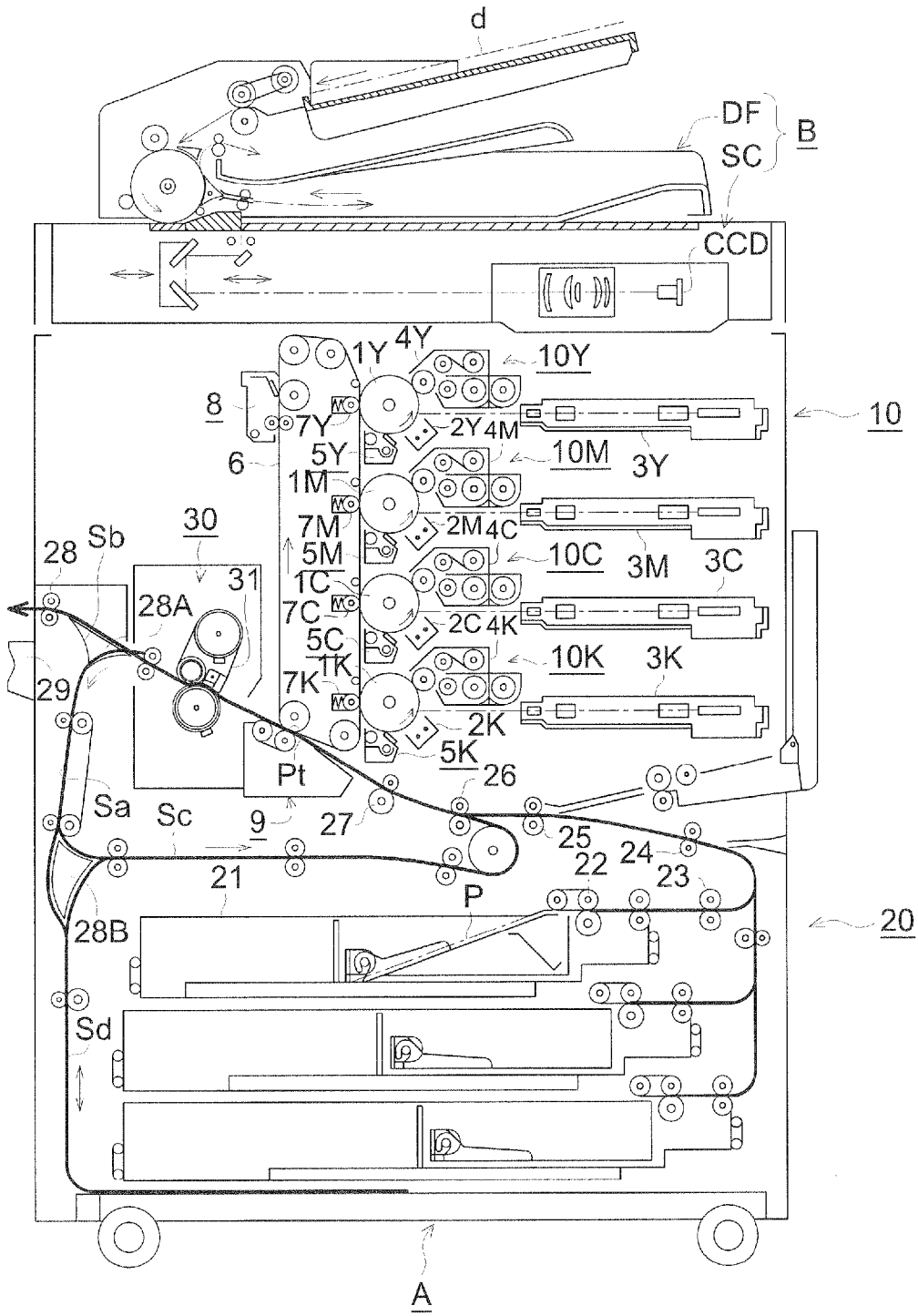
FIG. 1 is a sectional view showing a structure of image forming apparatus A relating to the present invention.

FIG. 1 is a sectional view showing a structure of image forming apparatus A relating to the present invention.

Image forming apparatus A is provided with image reading apparatus B placed at the upper portion of the body of image forming apparatus A.

Image forming apparatus A is referred to as a tandem type color image forming apparatus, and comprises image forming section 10 forming a toner image of plural colors on intermediate transfer body 6 as an image bearing member, and then transfers the toner image onto sheet P to form a toner image on sheet P; sheet feeding section 20 feeding and conveying sheet P to image forming section 10; and fixing device 30 fixes the toner image, formed on sheet P, onto sheet P.

Original document d placed on a document placement table is scanning exposed by a scanning exposure optical system of image reading device SC, and the image is transferred onto line image sensor CCD. Line image sensor CCD photoelectrically converts the transferred image to create the manuscript data, yellow (Y), magenta (M), cyan (C), and black (K), which data are then transferred to image processing section IP.

The manuscript data of each color are subjected to analogue processing, A/D conversion, shading compensation, image-encoding processing, or the like, in non-illustrated image processing section IP, and then temporarily stored in non-illustrated image memory section IM.

Next, the original manuscript data of each color stored in image memory section IM are input, based on a printing instruction of the original manuscript, in exposure section 3Y, 3M, 3C, and 3K for each color, each of which is contained in image forming section 10.

Image forming section 10 comprises yellow image forming unit 10Y forming a yellow toner image on intermediate transfer body 6 as an image bearing member, and, in a similar way, magenta image forming unit 10M forming a magenta image, cyan image forming unit 10C forming a cyan toner image, and black image forming unit 10K forming a black toner image.

Yellow image forming unit 10Y is structured of photoreceptor 1Y, charging section 2Y which is disposed around photoreceptor 1Y, exposing section 3Y, developing section 4Y, photoreceptor cleaning section 5Y, and primary transfer section 7Y. Charging section 2Y and exposing section 3Y, corresponding to yellow manuscript data, form an electrostatic latent image on photoreceptor 1Y. Developing section 4Y accommodates a two-component developer composed of yellow toner and carrier, and develops the electrostatic latent image using the two-component developer to form a yellow toner image on photoreceptor 1Y.

Primary transfer section 7Y is disposed downstream of developing section 4Y, and transfers the yellow toner image formed on photoreceptor 1Y onto intermediate transfer body 6. Photoreceptor cleaning section 5Y removes the residual toner remaining on photoreceptor 1Y which was not transferred by primary transfer section 7Y, and restores photoreceptor 1Y to a state in which it can form an image again.

In a similar manner, magenta image forming unit 10M is structured of photoreceptor 1M, charging section 2M which is disposed around photoreceptor 1M, exposing section 3M, developing section 4M, primary transfer section 7M, and photoreceptor cleaning section 5M, and forms a magenta toner image on intermediate transfer body 6.

In the similar manner, cyan image forming unit 10C is structured by photoreceptor 1C, charging section 2C which is disposed around photoreceptor 1C, exposing section 3C, developing section 4C, primary transfer section 7C, and photoreceptor cleaning section 5C, and forms a cyan toner image on intermediate transfer body 6.

Further, black image forming unit 10K is structured of photoreceptor 1K, charging section 2K which is disposed around photoreceptor 1K, exposing section 3K, developing section 4K, primary transfer section 7K, and photoreceptor cleaning section 5K, and forms a black toner image on intermediate transfer body 6.

As described above, each colored toner image formed on each of photoreceptors 1Y, 1M, 1C, and 1K is successively transferred onto intermediate transfer body 6 by each of primary transfer section 7Y, 7M, 7C and 7K, and thereby a toner image composed of each colored toner is formed on intermediate transfer body 6.

Sheet feeding section 20 comprises sheet feed tray 21 accommodating sheet P; paper feed section 22 feeding sheet P accommodated in sheet feed tray 21; a plurality of conveying roller pair 23, 24, 25, 26 and registration roller conveying sheet P fed by paper feed section 22 to secondary transfer position Pt, and conveys sheet P to secondary transfer position Pt.

Secondary transfer section 9, as a transfer means, collectively transfers each colored toner image formed on intermediate transfer body 6, which is wound around a plurality of rollers and rotates via a non-illustrated driving section, onto sheet P at secondary transfer position Pt.

Intermediate transfer cleaning section 8 is disposed downstream of secondary transfer position Pt, and removes the residual toner remaining on intermediate transfer body 6 which was not transferred by secondary transfer section 9, and cleans intermediate transfer body 6 so that it can be used again.

Sheet P, on which a toner image composed of each colored toner is formed, is separated due to different radii of curvature and conveyed to fixing device 30. Fixing device 30 exerts heat and pressure on conveyed sheet P to fix the color image on sheet P.

Sheet feeding section 20 processes sheet P in a plurality of ways, which sheet was processed by fixing device 30.

The first way is that sheet P processed at fixing device 30 is directly conveyed to sheet discharge rollers 28 to be placed on sheet discharge tray 29 which is attached outside the apparatus main body.

The second way is the case where sheet P, having been fixed, is reversed and discharged, and then sheet P is conveyed to first conveying path Sa located downward by branching board 28A, and after that sheet P is reversely conveyed to make it pass through second conveying path Sb to discharge it outside the apparatus by sheet discharge rollers 28.

The third way is the case where an image is formed on both surfaces of sheet P, and then sheet P, on which an image is formed on the first surface and fixed, is conveyed to secondary transfer position Pt through both surfaces conveying path Sc which is structured by first conveying path Sa, third conveying path Sd and fourth conveying path Sc. Sheet P is conveyed with turning front to back of the sheet while sheet P goes through both surfaces conveying path Sc. Then, a toner image is formed on the second surface of sheet P at secondary transfer position Pt. After that sheet P which was processed again by fixing device 30 is directly conveyed to sheet discharge rollers 28 to be placed on sheet discharge tray 29 which is attached outside the apparatus main body.

[Photoreceptor Cleaning Section]

Figure 2:
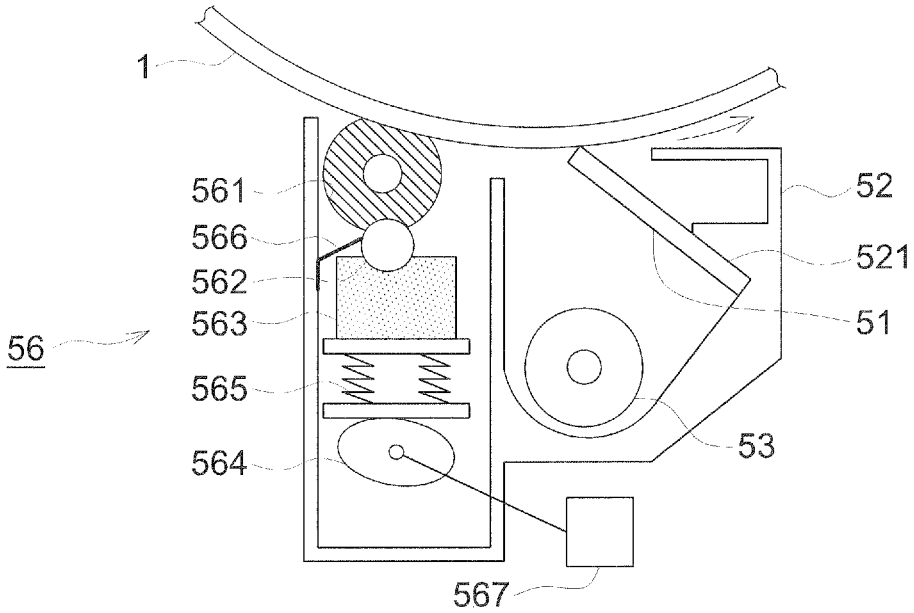
FIG. 2 is an expanded sectional view showing a structure of photoreceptor cleaning section 5Y, 5M, 5C, and 5K which are disposed around photoreceptors 1Y, 1M, 1C, and 1K of each color.

FIG. 2 is an expanded sectional view showing a structure of photoreceptor cleaning section 5Y, 5M, 5C, and 5K which are disposed around photoreceptors 1Y, 1M, 1C, and 1K of each color.

Since each of photoreceptor cleaning section 5Y, 5M, 5C, and 5K has an identical configuration, the photoreceptor cleaning section is referred to as photoreceptor cleaning section 5, and symbols Y, M, C, and K are omitted in the following descriptions.

Photoreceptor cleaning section 5 comprises cleaning blade 51 and lubricant applying section 56 which applies a solid lubricant to photoreceptor 1 in order to suppress wear of photoreceptor 1 caused by cleaning blade 51. Cleaning blade 51 scrapes together and removes residues such as toner remaining on photoreceptor 1 after the image was transferred, and is made of an elastic rubber body such as urethane rubber. Lubricant applying section 56 is disposed upstream of the rotation direction of photoreceptor 1 with respect to cleaning blade 51, and comprises brush roller 561, lubricant supply body 563, cam 564, and coil spring 565.

Brush roller 561 is preferably a roller in which an electrically conductive fiber brush is formed on a roller made of aluminum or the like, and applies lubricant K to photoreceptor 1 as well as supplementarily removes residue on photoreceptor 1. Further, it is preferable that a voltage having a polarity opposite to the toner charge on photoreceptor 1 is applied to brush roller 561, or brush roller 561 is grounded.

Intermediate roller 562 scrapes off lubricant K from lubricant supply body 563 and applies it to brush roller 561. Further, intermediate roller 562 removes toner or the like from brush roller 561, and toner or the like on brush roller 561 is removed by scraper 566 made of PET film or the like.

Lubricant supply body 563 is a solid lubricant in block form. The back of lubricant supply body 563 is urged by coil spring 565, which surface is then scraped off by being pressed against intermediate roller 562, and lubricant K is supplied onto intermediate roller 562.

Pressure switching section 567 is connected to cam 564, changes the rotation angle of cam 564, and changes the pressing force to make it possible to control the supplied quantity of solid lubricant which is applied to photoreceptor 1.

The solid lubricant is applied onto the surface of the photoreceptor for the purpose of mainly improving the cleaning property, and is in general composed of a metal salt of fatty acid. Specific examples of the lubricant include; a metal salt of stearic acid such as zinc stearic acid, aluminum stearic acid, copper stearic acid, and magnesium stearic acid; a metal salt of oleic acid such as zinc oleic acid, manganese oleic acid, iron oleic acid, copper oleic acid, and magnesium oleic acid; a metal salt of palmitic acid such as zinc palmitic acid, copper palmitic acid, and magnesium palmitic acid; a metal salt of linoleic acid such as zinc linoleic acid; and a metal salt of ricinoleic acid such as zinc ricinoleic acid, and lithium ricinoleic acid. Zinc stearic acid is particularly preferable.

[Intermediate Transfer Cleaning Section as a Cleaning Means]

Figure 3:
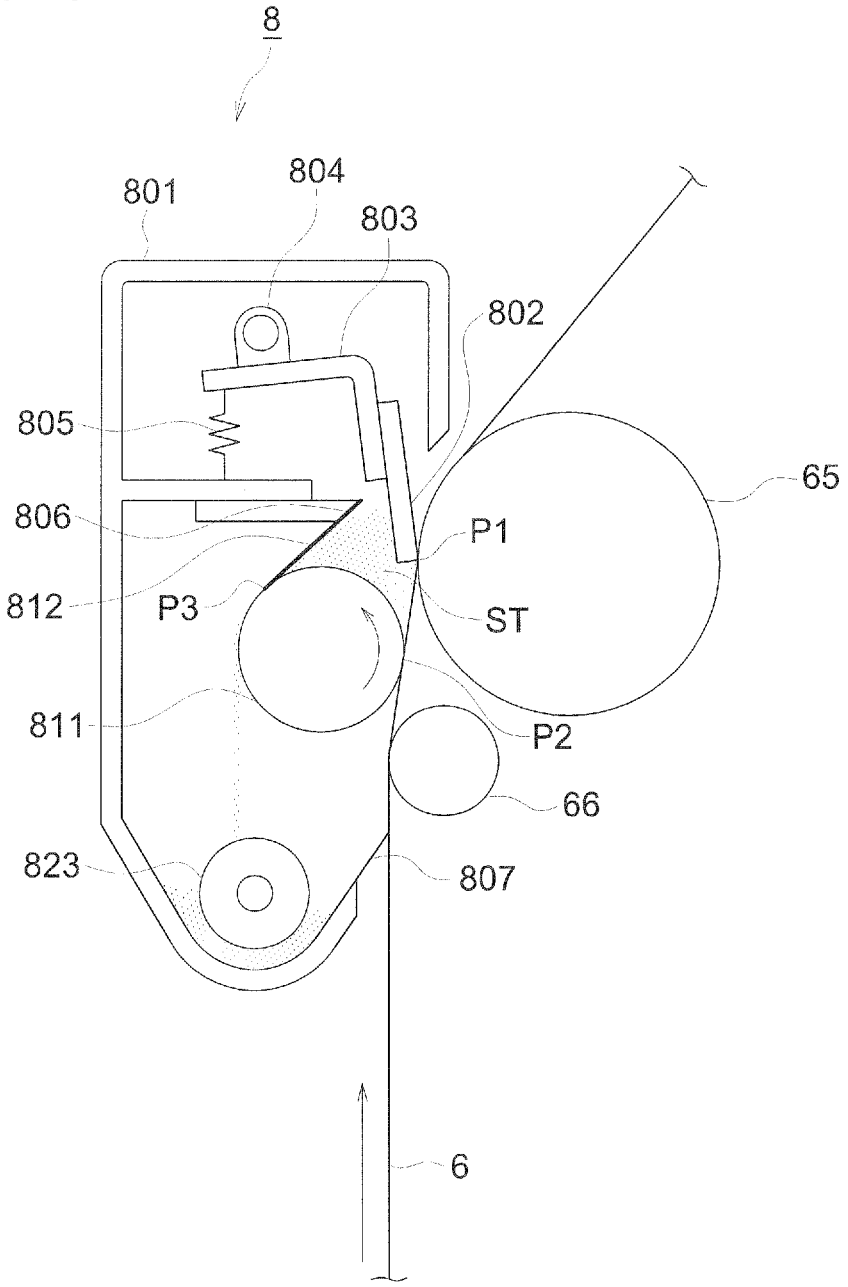
FIG. 3 is an expanded sectional view showing a structure of intermediate transfer cleaning section 8 as the cleaning means relating to the present invention.

FIG. 3 is an expanded sectional view showing a structure of intermediate transfer cleaning section 8 as the cleaning means relating to the present invention.

Numeral 801 is a casing, on which each member composing intermediate transfer cleaning section 8 is attached, and comprises a storage unit which accommodates toner removed from intermediate transfer body 6.

Cleaning blade 802 is made of an elastic body such as urethane rubber, and is fixed to blade holder 803 with an adhesive or the like.

Blade holder 803 is rotatably installed on blade supporting shaft 804 arranged at casing 801.

Pressing spring 805 urges blade holder 803 counter-clockwise as shown in the figure around blade supporting shaft 804. The tip of cleaning blade 802 makes close contact with intermediate transfer body 6 at pressing position P1 facing the reverse direction of rotation of intermediate transfer body 6.

Sponge roller 811 is disposed upstream of pressing position P1 in the rotation direction of intermediate transfer body 6, and makes close contact with intermediate transfer body 6 which is stretched and supported by tension roller 66 at close contact position P2 shown in the figure. Sponge roller 811 is driven in the same direction as intermediate transfer body 6 by a non-illustrated driving section so that the circumferential speed thereof is higher than that of intermediate transfer body 6.

Toner discharge control member 812 is made of a sheet of PET, and an edge thereof makes close contact with the surface of sponge roller 811 at close contact point P3 on the opposite side of close contact position P2, and the other edge is adhered and fixed with double-sided adhesive tape or the like to supporting part 806 of casing 801.

Storage space ST is a space which is defined, as shown in figure, by intermediate transfer body 6, sponge roller 811, and toner discharge control member 812, and is formed upstream of the pressing position P1 in the rotation direction of intermediate transfer body 6, and therefore is fully capable of storing toner removed by cleaning blade 802. A part of toner stored in storage space ST is supplied to intermediate transfer body 6 as a solid lubricant, and restrains the lip of cleaning blade 802 and the wear of intermediate transfer body 6. Toner discharge control member 812 is made of an elastic PET sheet, and has a function to increase the toner discharged from close contact point P3 according to an increase in the toner stored in storage space ST, and thereby a quantity of toner larger than a predetermined amount is continually kept in storage space ST.

As described above, since a proper amount of toner as a solid lubricant is continually supplied to the tip of cleaning blade 802, prevention of wear of intermediate transfer body 6 and the lip of cleaning blade 802 is made possible without applying lubricant K to intermediate transfer body 6 like that used in the photoreceptor cleaning section 5. In addition, occurrence of image failure such as transfer unevenness due to the fact that lubricant K excessively adheres locally to intermediate transfer body 6 is prevented.

[Secondary Transfer Section]

Figure 4:
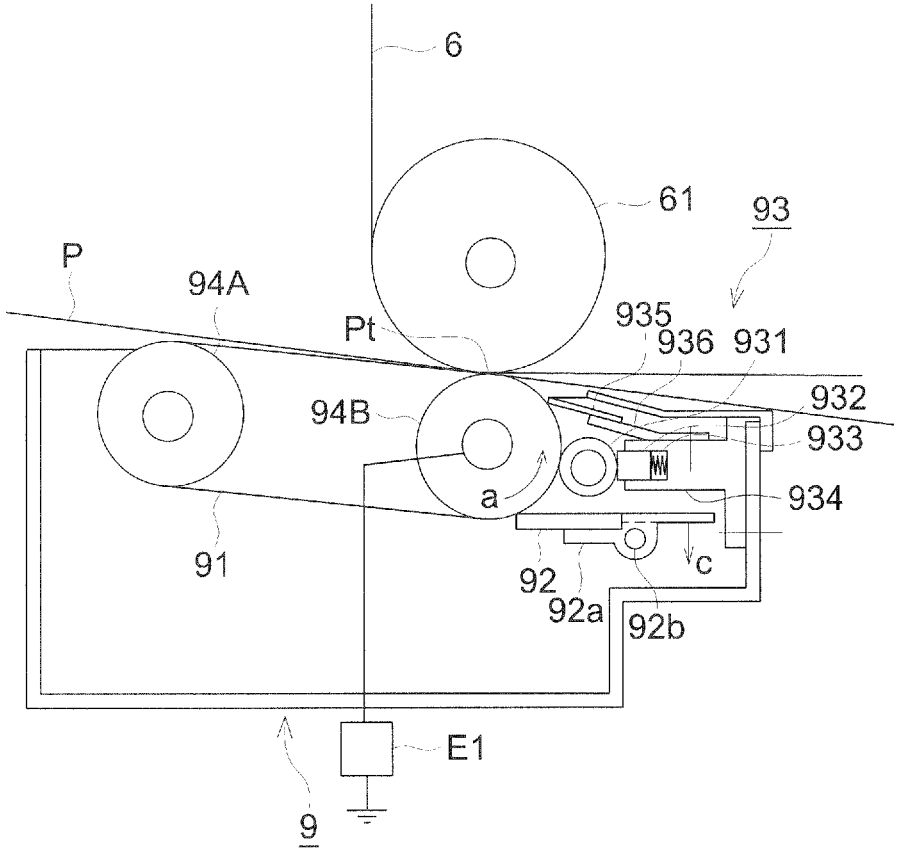
FIG. 4 is an expanded sectional view showing a structure of secondary transfer section 9 as the transfer means relating to the present invention.

FIG. 4 is an expanded sectional view showing a structure of secondary transfer section 9 as the transfer means relating to the present invention.

Secondary transfer section 9 comprises transfer belt 91 collectively transferring a toner image, on intermediate transfer body 6, onto sheet P at secondary transfer position Pt; secondary transfer blade 92 which removes residual toner or the like on the transfer belt; and lubricant applying roller 931 which applies lubricant K onto transfer belt 91 in order to reduce wear of transfer belt 91.

Transfer belt 91 is, as shown in the figure, suspended with driving roller 94A and secondary transfer roller 94B from the internal circumference, and rotates in arrow "a" direction by rotation of the driving roller. High voltage power source E1 is connected to secondary transfer roller 94B, and thereby a bias voltage is applied to secondary transfer roller 94B to transfer the toner image on intermediate transfer body 6 onto sheet P.

Secondary transfer blade 92 is a urethane rubber blade, and is heat welded to blade supporting member 92*a*. By a non-illustrated urging section which urges in arrow c direction the other edge of blade supporting member 92*a*, which is rotatably supported by supporting shaft 94*b* fixed to the casing, the tip of secondary transfer blade 92 is brought into close contact with transfer belt 91 to scrape and collect foreign matter such as toner left on transfer belt 91, and paper powder.

Lubricant applying section 93 is disposed downstream of secondary transfer blade 92 in the rotation direction of transfer belt 91, and brings lubricant applying roller 931, on which surface lubricant K is applied, into close contact with transfer belt 91 to continually supply lubricant K on transfer belt 91, and thereby restrains the wear of transfer belt 91 due to secondary transfer blade 92.

Lubricant applying roller 931 is rotatably attached to supporting member 934 which is fixed to the casing of secondary transfer section 9. The tip of lubricant applying roller 931 makes close contact with transfer belt 91 at a position indicated by Pk in the moving direction of transfer belt 91, and rotates clockwise in FIG. 4 by a non-illustrated driving mechanism to supply lubricant K onto transfer belt 91.

Lubricant block 932 is a solid in a quadrangular form, and, as shown in the figure, one surface of the quadrangular prism is made in close contact with lubricant applying roller 931 by urging force of compressed spring 933. Here, a metal salt of fatty acid is used similarly to lubricant supply body 563 of photoreceptor cleaning section 5. Included are, for example, zinc stearic acid, calcium stearic acid, and aluminum stearic acid.

Blade 935 is disposed downstream of lubricant applying roller 931 in the rotation direction of transfer belt 91, and any excessive lubricant K applied onto transfer belt 91 is uniformly spread, and thereby transfer belt 91 is covered with lubricant K so lightly that no transfer unevenness or unclear image occurs.

[Control Section]

Figure 5:
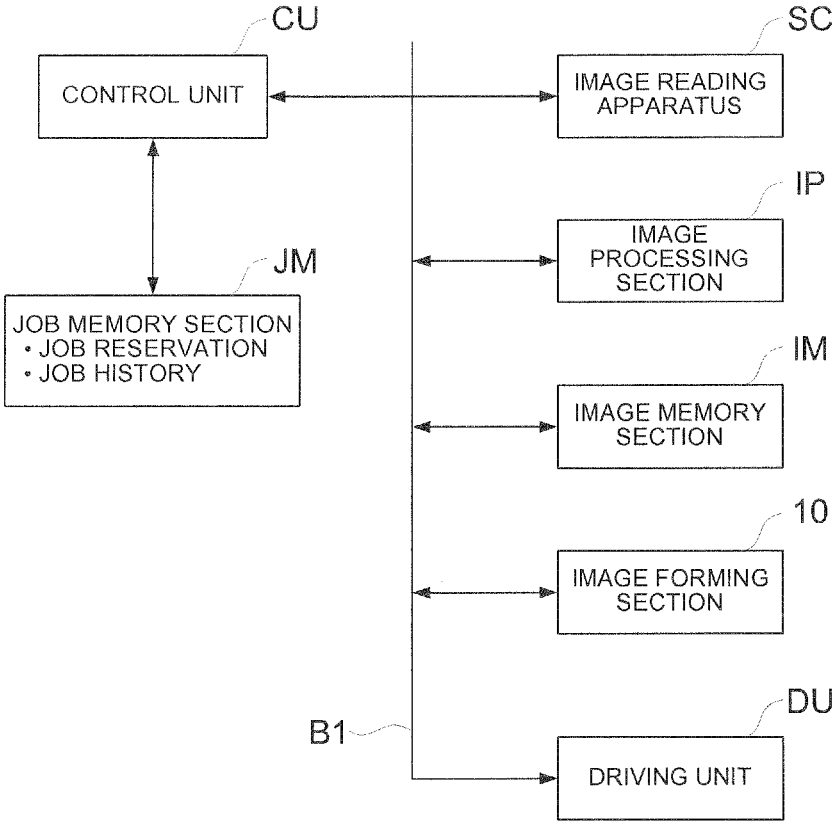
FIG. 5 is a block diagram showing a major portion involving control unit CU relating to the present invention.

FIG. 5 is a block diagram showing a major portion involving control unit CU relating to the present invention. As shown in the figure, control section CU controls image forming apparatus A in an integral fashion in communication, via bus BS, with image reading device SC, image processing unit IP, image memory unit IM, image forming section 10, driving unit DU, job memory section JM, or the like.

Driving unit DU has a driving circuit which drives a non-illustrated motor, clutch, or the like which are incorporated in a driving mechanism of photoreceptors 1Y, 1M, 1C, and 1K and intermediate transfer body 6, and sets rotation/stop, reverse rotation, or speed of photoreceptors 1Y, 1M, 1C, and 1K and intermediate transfer body 6 according to instructions of control unit CU.

Job memory section JM stores job information of a reserved printing job, an executed printing job, and contents of jobs thereof. Image memory unit IM stores, in equivalence with the job information, printing data of a reserved printing job and image data (bitmap data) which will be processed at image forming section 10.

For example, control unit CU, after job memory section 1M reads out stored job information, obtains the size of sheet P being passed through at the currently running printing job and the size of sheet P having been passed through during the previous printing job, which was executed immediately before the current printing job.

[Generation Mechanism of Cleaning Failure]

The content in which the inventors diligently studied on the following problem will be detailed below: the problem is that, in the case where large size printing jobs are continually carried out after small size printing jobs were continually carried out, cleaning failure occurs in both side areas in the main scanning direction of the sheet of paper before the cleaning action of cleaning blade 802 is carried out, namely "a cleaning problem occurs in large size printing jobs after small size printing jobs."

The inventors found that the transfer of lubricant K from the upper portion of transfer member 91 to intermediate transfer body 6 has a relation with the above cleaning problem, and clarified the generation mechanism in which the cleaning failure occurs by the transfer of lubricant K.

[Generation Mechanism of Cleaning Failure]

Figure 6A:
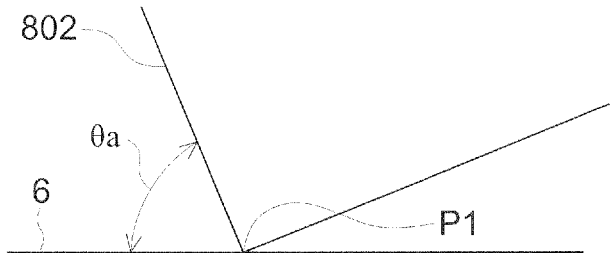
FIGS. 6*a*, 6*b*, and 6*c* are schematic illustrations showing the edge configuration of cleaning blade 802 being pressure contacted to intermediate transfer body 6.
Figure 6B:
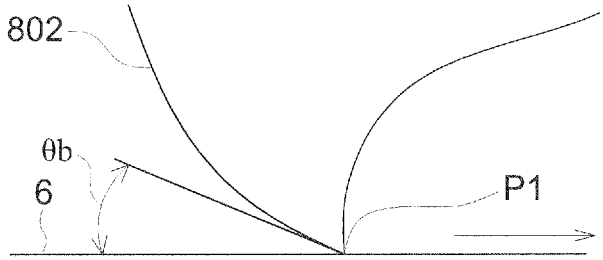
Figure 6C:
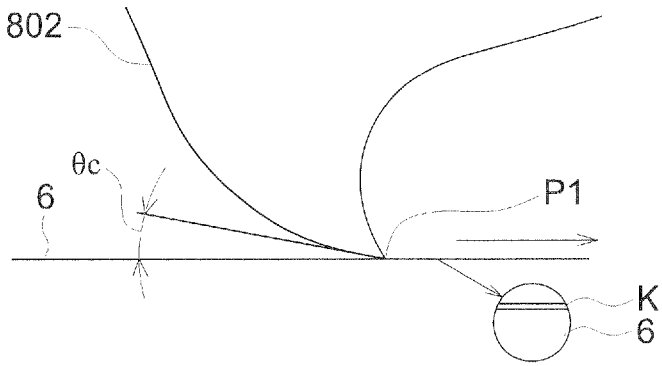

FIGS. 6*a*, 6*b*, and 6*c* are schematic illustrations showing the configuration of cleaning blade 802 being pressure contacted to intermediate transfer body 6.

FIG. 6*a* is a schematic illustration showing a configuration of cleaning blade after intermediate transfer body 6 was stopped, and FIGS. 6*b* and 6*c* are schematic illustrations showing configurations of cleaning blade during rotation of intermediate transfer body 6.

On intermediate transfer body 6 of FIG. 6*b*, no lubricant K exists, while on intermediate transfer body 6 of FIG. 6*c*, lubricant K is applied.

The edge of cleaning blade 802 is pulled downstream by sliding force due to the rotation of intermediate transfer body 6, and as a result cleaning blade 802 is deformed into configurations like FIGS. 6*b* and 6*c*. When cleaning blade 802 stops, it returns to a configuration like in FIG. 6*a*. When the rotation of intermediate transfer body 6 stops, intermediate transfer body 6, near pressing position P1, rotates in the upstream direction (in the reverse direction), and then cleaning blade 802 returns to a configuration as in FIG. 6*a*.

θa, θb, and θc are crossing angles (a tentative name) in which an edge face on the tip of cleaning blade 802 and intermediate transfer body 6 cross each other. θa is tentatively referred to as the initial crossing angle, and θb and θc are tentatively referred to as the crossing angle at work.

The edge of cleaning blade 802 is pulled downstream by sliding force of intermediate transfer body 6, and the edge configuration gradually increases in deformation as time advances, and then the crossing angles at work θb and θc gradually become smaller. It is assumed that the edge configuration changed from the configuration of FIG. 6*a* to FIGS. 6*b* and 6*c*.

As indicated by a relationship θb>θc, in the case where lubricant K is applied to intermediate transfer body 6, the sliding force of intermediate transfer body 6 against cleaning blade 802 is increased compared to the case where no lubricant K is applied. In addition, according to the amount of application of lubricant K, the sliding force due to intermediate transfer body 6 is increased. Therefore, the crossing angle at work θc becomes smaller according to the amount of application of lubricant K on intermediate transfer body 6.

Lubricant K on intermediate transfer body 6 is taken up by sheet P for each sheet passed in the sheet passed area, and gradually decreases due to repeated passed sheets. The amount of lubricant being taken up depends on the type of the sheet of paper, and for example the amount is large for smooth paper. Further, in the non-sheet passed area, which is outside sheet P passed area, lubricant K is transferred from transfer member 91 to intermediate transfer body 6, and then lubricant K on intermediate transfer body 6 gradually increases due to repeated passed sheets.

Furthermore, once rotation of intermediate transfer body 6 is initiated, the deformation of the edge configuration of cleaning blade 802 may change to increase over time, but it does not change to decrease. Therefore, the change over time of the crossing angle at work θc at each part in the main scanning direction is determined by the applied amount of lubricant K at initiation of rotation, the type or size of sheet P being passed through, or the like.

The rotation of intermediate transfer body 6 is initiated, and when crossing angle at work θc gradually decreases to less than or equal to the critical angle θr, the part of toner supplied from storage space ST onto intermediate transfer body 6 squeezes under the edge of cleaning blade 802 to cause image stain on sheet P. Namely, it is assumed that the cleaning failure has occurred.

[Countermeasure Against Cleaning Failure]

Next, a "measure to prevent cleaning failure due to transfer of lubricant K", relating to the present invention, will be detailed.

Figure 7:
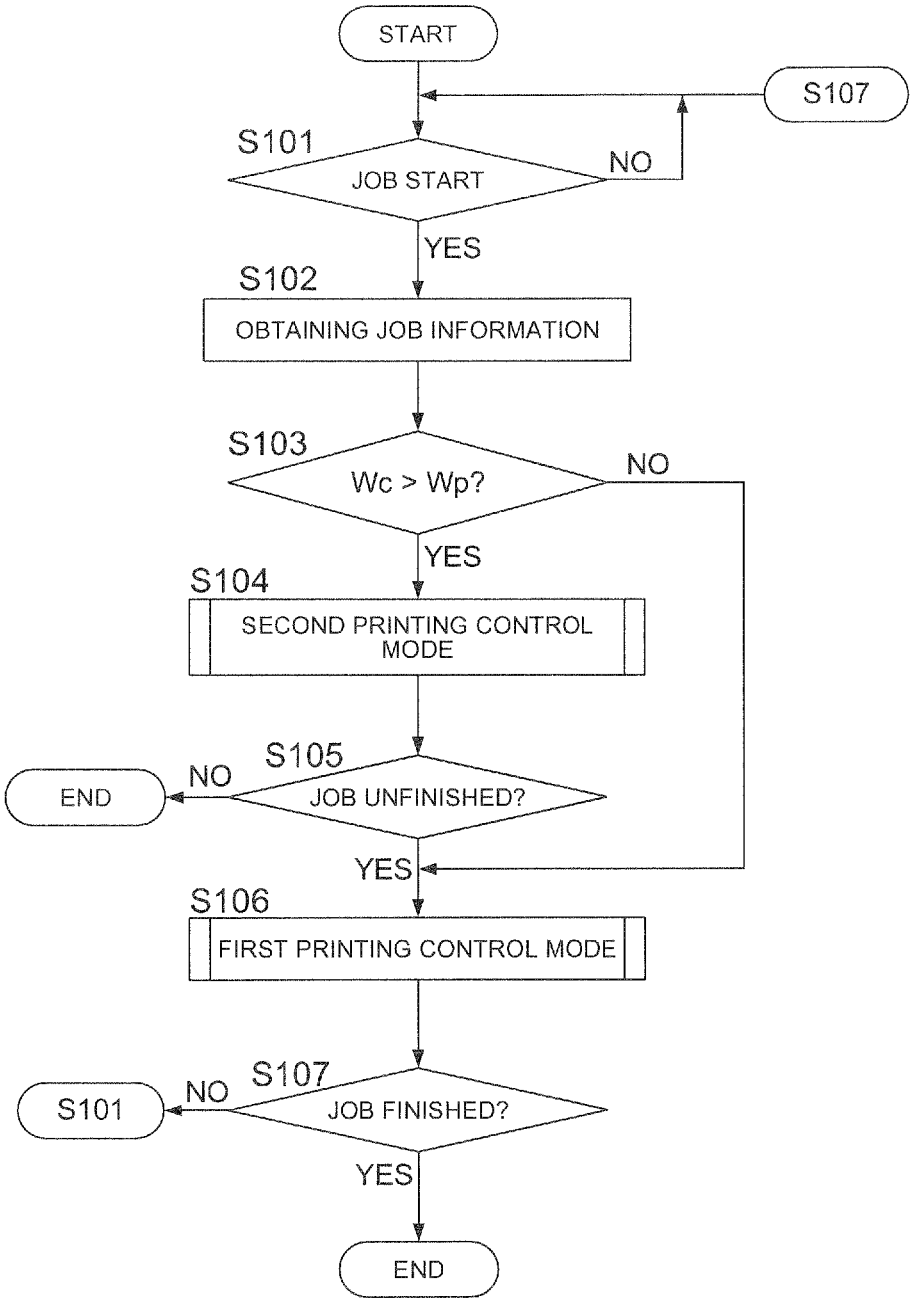
FIG. 7 is a flowchart showing an embodiment of a control to prevent cleaning failure relating to the present invention, which is managed by control unit CU.

FIG. 7 is a flowchart showing an embodiment of a control to prevent cleaning failure relating to the present invention, which is managed by control unit CU.

S101 is a step to determine the start or resumption of a printing job. When the start of the printing job is determined, the procedure goes to step S102.

S102 is a step to read out contents of reserved printing job information (job reservation) and printed printing job information (job history) from job memory section JM, and to obtain size Wp of the sheet (in the main scanning direction, namely in the direction perpendicular to the sheet conveyance direction; hereinafter it is omitted) having being passed through at the previous printing job in which the printing was finished just before the current job, and size Wc of the sheet (in the main scanning direction; hereinafter it is omitted) being passed through at the current printing job to be executed. Next, the procedure goes to step S103.

S103 is a step to determine the magnitude relation between size Wp of the sheet having been passed through at the previous printing job and size Wc of the sheet being passed through at the current printing job.

In the case where the determination result is Wc>Wp (in the case of Yes), the procedure goes to step S104, and in the case where Wc≤Wp (in the case of No), the procedure goes to step S106.

S104 is a step of the second printing control mode in which, when rotation length L, as the amount of rotation of intermediate transfer body 6, reaches the second predetermined value $R_2$ while allowing the printing to progress, S104 carries out an additional return action of cleaning blade configuration to prevent cleaning failure due to transfer of lubricant K.

Rotated distance L is a distance (m) in which intermediate transfer body 6 rotated from after initiation of rotation to an optional point of time, but it is not limited to the rotated distance, and variables being possible to correspond to rotated distance L of intermediate transfer body 6 are also covered. For example, the number of sheets being subjected to printing, the operating time of intermediate transfer body 6, or the like corresponds to rotated distance L of intermediate transfer body 6.

Figure 8:
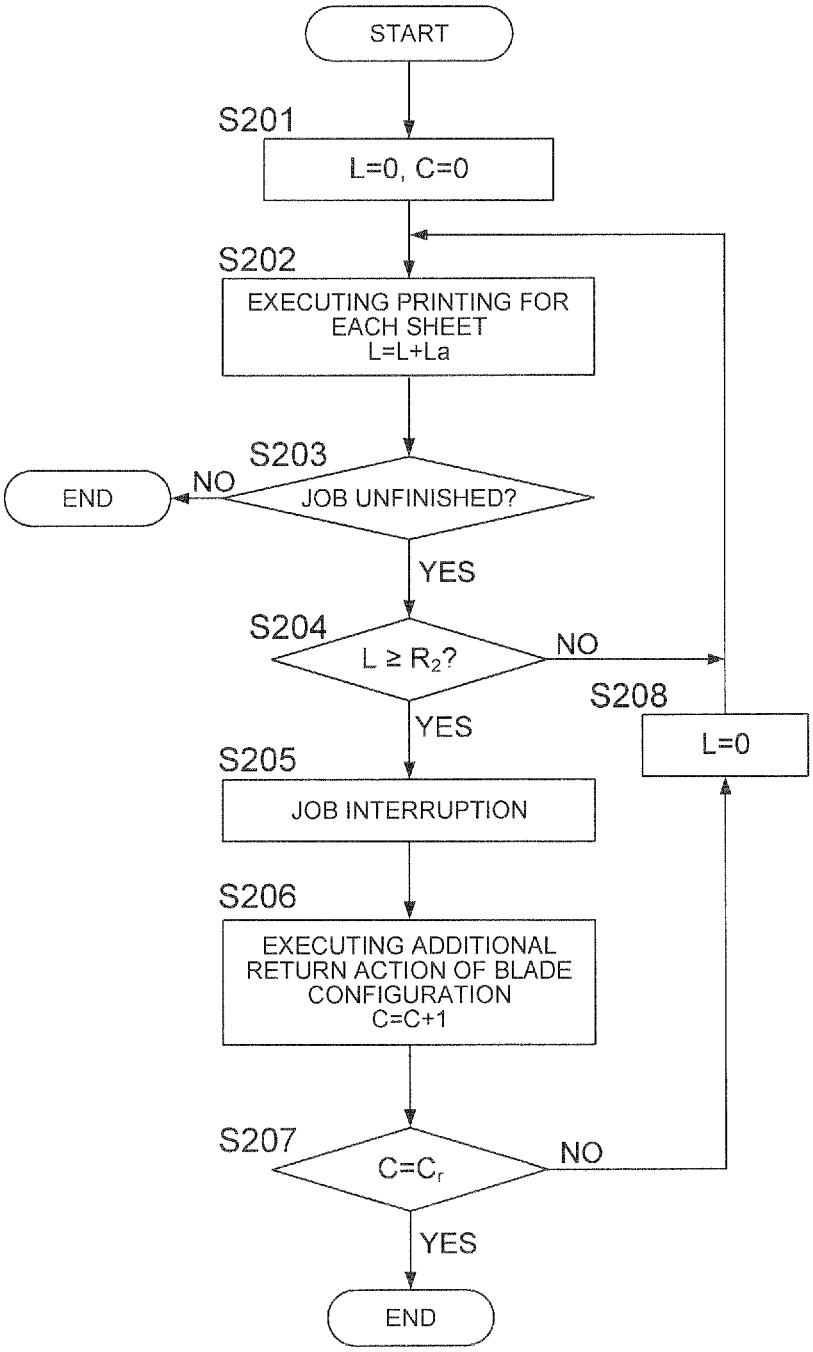
FIG. 8 is a flowchart showing the structure of the first printing control mode carrying out a regular return action of the cleaning blade configuration.

FIG. 8 is a flowchart showing the structure of the second printing control mode carrying out an additional return action of the cleaning blade configuration relating to the present invention.

S201 is a step to initialize rotated distance L of intermediate transfer body 6 and the number of executions C of return action of cleaning blade configuration, namely to reset L and C. After that, the procedure goes to step S202.

S202 is a step to execute printing for each sheet P having been passed through according to a printing job, and updates rotated distance L of intermediate transfer body 6, that is to calculate L=L+La. La is rotated distance L in which intermediate transfer body 6 rotates per sheet.

Next, S203 is a step to determine whether or not the printing job is unfinished. In the case of unfinished (in the case of Yes), the procedure goes to step S204, and in the case of finished (in the case of No), the second printing control mode is finished.

S204 is a step to determine whether or not rotated distance L of intermediate transfer body 6 is more than or equal to second predetermined value $R_2$, and in the case where L is more than or equal to second predetermined value $R_2$ (in the case of Yes), the procedure goes to steps S205 and S206. In the case where L is less than second predetermined value $R_2$ (in the case of No), the procedure goes back to step S202, and then steps S202 to S204 are repeated.

Control unit CU, if determined to be Yes at step S204, interrupts the currently running printing job (S206).

S206 is a step to execute an additional return action of cleaning blade configuration to stop the rotation of intermediate transfer body 6, and to update the number of above executions C. Specifically, S206 controls driving unit DU, stops the rotation of intermediate transfer body 6, executes an action to return the configuration of cleaning blade 802 to the state shown in FIG. 6*a*, and carries out an arithmetic processing of C=C+1. Then, the procedure goes to step S207.

Second predetermined value $R_2$ is set in advance, and is a reference value which determines an execution timing of an additional return action of blade configuration to prevent the occurrence of the cleaning failure due to the transfer of lubricant K. Second predetermined value $R_2$ is different from first predetermined value $R_1$ which determines an execution timing of a regular return action of blade configuration to prevent the occurrence of a lip of the blade due to foreign matters or the like or a cleaning failure, and $R_2$ and $R_1$ have a relation of $R_2<R_1$.

S207 is a step to determine whether or not the number of executions C of an additional return action of cleaning blade configuration reached the reference number of times $C_r$ being set in advance. Namely, S207 determines whether or not C and $C_r$ have the relationship $C=C_r$.

In the step S207, if it was determined that $C\neq C_r$ (No), the procedure goes to step S208, and rotated distance L of intermediate transfer body 6 is reset. And then, returning to step S202, the steps from S202 to S207 are repeated until C and $C_r$ have the relationship $C=C_r$.

In S207, if it was determined that $C=C_r$ (Yes), second printing control mode to carry out an additional return action of blade configuration is stopped.

Returning to FIG. 7, the above procedure is described. After the step of the second printing control mode, the procedure goes to step S105.

S105 is a step to determine whether or not the printing job is unfinished, and in the case of unfinished (in the case of Yes), the procedure goes to step S106, and in the case of finished (in the case of No), the control itself is finished.

S106 is a step of the first printing control mode in which, when rotation length L as the amount of rotation of intermediate transfer body 6 reaches the first predetermined value $R_1$ while allowing the printing to progress, S106 carries out only a regular return action of cleaning blade configuration to prevent the lip of the blade due to foreign matter or the like, or cleaning failure.

Figure 9:
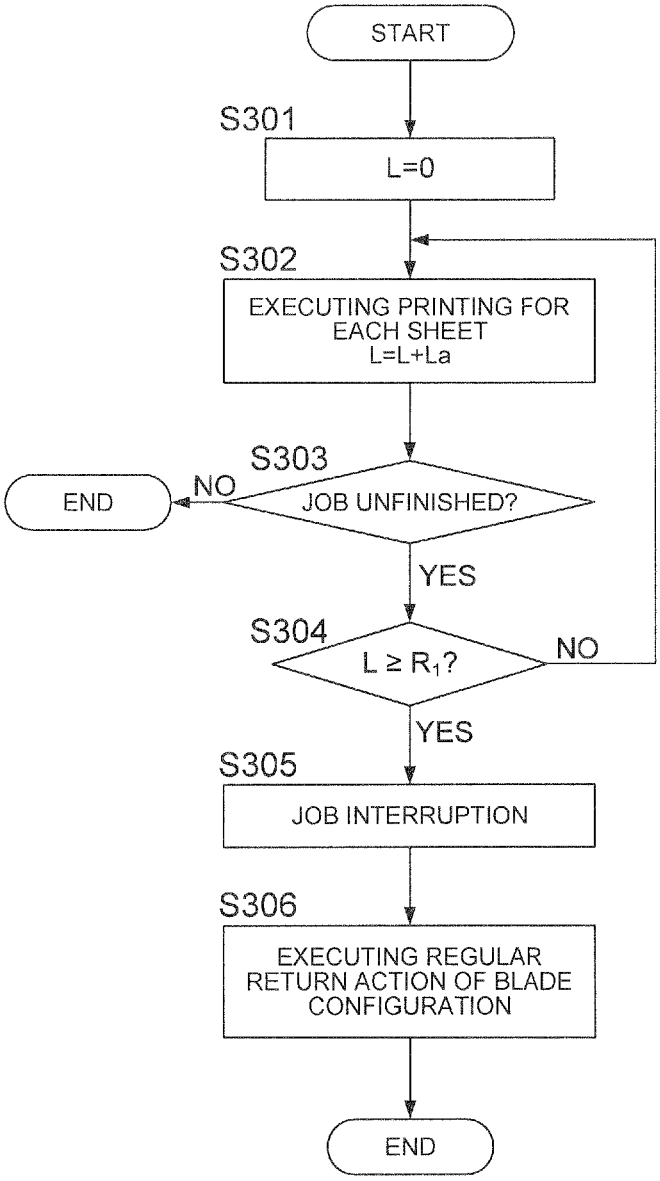
FIG. 9 is a flowchart showing the structure of the second printing control mode carrying out an additional return action of the cleaning blade configuration relating to the present invention.

FIG. 9 is a flowchart showing a structure of the first printing control mode carrying out a regular return action of a cleaning blade configuration, which will be described below.

S301 is a step to reset rotated distance L of intermediate transfer body 6, and after the processing, the procedure goes to step S302.

S302 is a step to carry out printing for each sheet P having been passed through according to the printing job, and to update rotated distance L of intermediate transfer body 6.

S303 is a step to determine whether or not the printing job is unfinished. In the case of Yes (that is the printing job is unfinished), the procedure goes to step S304, and in the case of No (that is the printing job is finished), the first printing control mode is finished and the procedure goes to step S107 of FIG. 7.

S304 is a step to determine whether or not rotated distance L of intermediate transfer body 6 is more than or equal to first predetermined value Rt. In the case of less than first predetermined value $R_1$ (in the case of No), the procedure goes back to S301, and then the steps from 5301 to S304 are repeated until rotated distance L of intermediate transfer body 6 reaches a value more than or equal to first predetermined value $R_1$. And then, when the value is determined to be more than or equal to first predetermined value $R_1$ (when determined to be Yes), the currently running job is interrupted (step S305), and the procedure goes to step S306.

S306 is a step to carry out a regular return action of a cleaning blade configuration, and the series of first printing control mode is finished, and then the procedure goes to step S107 of FIG. 7.

Returning to FIG. 7, the description is continued.

S107 is a step to determine whether or not the printing job is unfinished. In the case of unfinished (in the case of No), the procedure goes back to step S101, and the series of steps are repeated until the printing job is finished.

But since the second run, the determination result in step S103 becomes the relationship Wc=Wp, and therefore, only the first printing control mode is repeated until the printing job is completed.

As described above, in the case where large size printing jobs are carried out after small size printing jobs, control unit CU carries out the additional return action of the cleaning blade configuration before the regular return action of the cleaning blade configuration, based on predetermined second predetermined value $R_2$, or reference number of times $C_r$, and thereby it makes possible to assuredly prevent the occurrence of the cleaning failure due to the transfer of lubricant K onto intermediate transfer body 6 before it happens.

Default values of second predetermined value $R_2$ and reference number of times $C_r$ at the time of their installation are rewritable by operations of operators, managers or the like, and it is possible to suitably set the values $R_2$ and $C_r$ in accordance with the usage environment of image forming apparatus A.

[Embodiment (1) of Second Predetermined Value $R_2$ and Reference Number of Times $C_r$]

Embodiment (1) makes it possible to minimize the impact of productivity decline of the printing job by setting second predetermined value $R_2$ and reference number of times $C_r$ based on minimum ratio Dmin of sheet passed among ratios D of sheet passed which was calculated using the following formula at each area in which the sheet passed area, through which sheets are passed at the above current printing job, is divided in the main scanning direction.

$D=L_p/L_a$, where $L_p$ is the total length (m) in the sub-scanning direction of all sheets being passed through during prescribed period $T_a$ of the previous printing job, and $L_a$ is the rotated distance (m) of intermediate transfer body 6 rotating during prescribed period $T_a$.

As prescribed period $T_a$, usable are the rotated distance of intermediate transfer body 6, the driving time, or the number of printing sheets. An example of the rotated distance is several tens of meters to several hundreds of meters. The previous printing job means all of the printing jobs executed in the aforesaid prescribed period, and is a concept which includes a plurality of printing jobs.

An example is that, in an image forming apparatus in which sheets are conveyed with the center criterion of a sheet, the previous printing jobs executed in 200 m of the rotated distance of intermediate transfer body 6 as the last prescribed period $T_a$ include printing job 1 and printing job 2, and printing job 1 assumes B35 size (the main scanning distance is 257 mm, and the one side length is 128.5 mm with the center criterion) and the rotated distance is 100 m (about 330 sheets), and printing job 2 assumes A4R size (the main scanning distance is 210 mm, and the one side length is 105.0 mm with the center criterion) and the rotated distance is 100 m (about 280 sheets). In this case, at the previous printing job, (a) the ratio of sheet passed is 60% in the inner area than A4R, (b) 30% in the outer area than A4R and in the inner area than B5, and (c) the ratio of sheet passed becomes 0% since no sheet was being passed through in the outer area than B5.

In this case, for an A4R sheet or a sheet which is narrower in the main scanning direction than the A4R sheet, any ratio D of sheet passed calculated at "each area in which the sheet passed area through which sheets are passed at the above current printing job is divided in the main scanning direction" become 60%, and as a result, minimum ratio Dmin of sheet passed is 60%. On the other hand, if the current job uses a sheet which is wider than B5, like a A4 size (the main scanning direction is 297 mm), ratio D of sheet passed calculated at "each area in which the sheet passed area through which sheets are passed at the above current printing job is divided in the main scanning direction" differ among areas (a) to (c) described above, and in this case, the area in which the ratio of sheet passed becomes minimum among areas in which sheets were passed through at the current printing job is the outer area than B5 and the inner area than A4 (the outer area than 128.5 mm and the inner area than 148.5 mm with the center criterion), and ratio Dmin of sheet passed becomes 0%.

Control unit CU, in the case where the sheet size of the current printing job (in the main scanning direction) is larger than the sheet size of the last printing job, calculates ratio D of sheet passed at each area in which the sheet passed area through which sheets are passed at the above current printing job is divided in the main scanning direction based on job information of all of the previous printing jobs and current printing jobs executed in prescribed period Ta went back from the current printing job as the example described above in advance of the execution of the second printing control mode shown in S104 of FIG. 7, and obtains minimum ratio Dmin of sheet passed among ratios D of sheet passed.

Next, control unit CU obtains second predetermined value $R_2$ and reference number of times $C_r$ from obtained ratio Dmin of sheet passed using a correspondence table which was registered in advance and relates minimum ratio Dmin of sheet passed to second predetermined value $R_2$ and reference number of times $C_r$.

Table 1 is an example of the correspondence table which relates minimum ratio Dmin of sheet passed to second predetermined value $R_2$ and reference number of times $C_r$.

TABLE 1

| Minimum ratio Dmin of sheet passed | Second predetermined value $R_2$ | Reference number of times $C_r$ |
|---|---|---|
| 0-0.3 | 50 m | 2 |
| 0.3-0.5 | 50 m | 1 |
| 0.5- | 600 m | 1 |

First predetermined value $R_1$ = 600 m

Among a plurality of previous printing jobs executed in prescribed period $T_a$, as the small size printing job, there exists only the last printing job, and further, in the case where the last printing job was a small scale job with a small number of sheets, minimum ratio Dmin of sheet passed to be obtained becomes larger, for example, it becomes a value exceeding 0.5.

And then, based on correspondence Table 1, second predetermined value $R_2$ is set to 600 m, being equivalent to first predetermined value $R_1$, and reference number of times $C_r$ is set to 1.

Therefore, the additional return action of blade configuration executed in the second printing control mode doubles as the regular return action of blade configuration executed in the first printing control mode, and as a result, the productivity of the printing job is not decreased. Further, in the case where ratio D of sheet passed in the previous printing job is large, the amount of applied lubricant K on intermediate transfer body 6 is small at the initiation of the current printing job, and therefore, without executing the additional return action of blade configuration, the configuration of cleaning blade 802 does not reach a state of cleaning failure, and there is no problem also in terms of prevention of cleaning failure.

Table 2 shows timings (rotated distance L of intermediate transfer body 6) in which an additional return action of blade configuration and a regular return action of blade configuration are executed, in the case where the current printing job (a large size and the number of continuous printing corresponding to rotated distance L=1,500 m of intermediate transfer body 6) is carried out after the previous printing job (a small size and ratio D of sheet passed shown in Table 2) was carried out.

TABLE 2

| Minimum ratio Dmin of sheet passed | Execution timing of additional return action of blade configuration Based on second predetermined value $R_2$ | Execution timing of regular return action of blade configuration Based on first predetermined value $R_1$ |
|---|---|---|
| 0-0.3 | 50 m, 100 m | 700 m, 1300 m |
| 0.3-0.5 | 50 m | 650 m, 1250 m |
| 0.5-1.0 | 600 m | 600 m, 1200 m |

Underlines added to execution timings show that the additional return action of blade configuration double as the regular return action of blade configuration and the underlined are duplicated.

Control unit CU executes the additional return action of blade configuration according to flowcharts of FIGS. 7, 8, and 9, and after that, executes the regular return action of blade configuration. Therefore, since the additional return action of blade configuration is executed according to the scale of the last small size previous printing job, the decrease in productivity of the printing job can be reduced compared to the case where the additional return action of blade configuration is uniformly executed regardless of the scale.

[Embodiment (2) of Second Predetermined Value $R_2$ and Reference Number of Times $C_r$]

Embodiment (2) also makes it possible to minimize the impact of productivity decline of the printing job by setting second predetermined value $R_2$ and reference number of times $C_r$ according to rotated distance L of intermediate transfer body 6 as defined below.

Rotated distance L of intermediate transfer body 6 is rotated distance L of intermediate transfer body 6 rotated with the previous printing job (a small size) immediately before the current printing job, and corresponds to the scale (the number of prints) of the last previous printing job.

Control unit CU, in the case where sheet size (in the main scanning direction) of the current printing job is larger than the sheet size of the last previous printing job, obtains rotated distance L of intermediate transfer body 6 rotated with the last previous printing job based on the job information of the last previous printing job executed prior to the execution of the second printing control mode shown in S104 of FIG. 7.

Next, control unit CU obtains second predetermined value $R_2$ and reference number of times $C_r$ from obtained rotated distance L of intermediate transfer body 6 using a correspondence table which was registered in advance and relates rotated distance L of intermediate transfer body 6 to second predetermined value $R_2$ and reference number of times $C_r$.

Table 3 is an example of the correspondence table which relates rotated distance L of intermediate transfer body 6 to second predetermined value $R_2$ and reference number of times $C_r$.

TABLE 3

| Rotated distance L | Second predetermined value $R_2$ | Reference number of times $C_r$ |
|---|---|---|
| 200 m ≤ L | 50 m | 2 |
| 100 m ≤ L < 200 m | 50 m | 1 |
| L < 100 m | 600 m | 1 |

As shown in Table 3, in the case where the small size previous printing job is a small scale such that rotated distance L of intermediate transfer body 6 rotated during the printing job is less than 100 m, first predetermined value $R_1$ is set to 600 m being equivalent to second predetermined value $R_2$, and reference number of times $C_r$ is set to 1.

Therefore, the additional return action of blade configuration executed in the second printing control mode doubles as the regular return action of blade configuration executed in the first printing control mode, and as a result, the productivity of the printing job is not decreased. Further, in the case where the small size previous printing job is a small scale, the amount of applied lubricant K on intermediate transfer body 6 is small at the initiation of the current printing job, and therefore, without executing the additional return action of blade configuration, the configuration of cleaning blade 802 does not reach a state of cleaning failure, and there is also no problem in terms of prevention of cleaning failure.

Table 4 shows timings (rotated distance L of intermediate transfer body 6) in which an additional return action of blade configuration and a regular return action of blade configuration are executed, in the case where the current printing job (a large size and the number of continuous printing corresponding to rotated distance L=1,500 m of intermediate transfer body 6) is carried out after the previous printing job (a small size and rotated distance L of intermediate transfer body 6) was carried out.

TABLE 4

| Rotated distance L of intermediate transfer body | Execution timing of additional return action of blade configuration Based on second predetermined value $R_2$ | Execution timing of regular return action of blade configuration Based on first predetermined value $R_1$ |
|---|---|---|
| 200 m ≤ L | 50 m, 100 m | 700 m, 1300 m |
| 100 m ≤ L < 200 m | 50 m | 650 m, 1250 m |
| L < 100 m | 600 m | 600 m, 1200 m |

Underlines added to execution timings show that the additional return action of blade configuration double as the regular return action of blade configuration and the underlined are duplicated.

Next, control unit CU executes the additional return action of blade configuration according to flowcharts of FIGS. 7, 8, and 9, and after that, executes the regular return action of blade configuration. Therefore, since the additional return action of blade configuration is executed according to the scale of the last small size previous printing job, the decrease in productivity of the printing job can be reduced compared to the case where the additional return action of blade configuration is uniformly executed regardless of the scale.

Further, in the case where rotated distance L of intermediate transfer body 6 in the last previous printing job is less than 100 m, the amount of applied lubricant K on intermediate transfer body 6 at the initiation of the current printing job is small, and therefore, without executing the additional return action of blade configuration, the configuration of cleaning blade 802 does not reach a state of cleaning failure, and there is also no problem in terms of prevention of cleaning failure.

[Embodiment (3) of Second Predetermined Value $R_2$ and Reference Number of Times $C_r$]

Embodiment (3) also makes it possible to minimize the impact of productivity decline of the printing job by setting second predetermined value $R_2$ and reference number of times $C_r$ according to maximum corrected rotated distance Φmax among corrected rotated distances Φ which was calculated using the following formulae at each area in which the sheet passed area through which sheets are passed at the current printing job is divided in the main scanning direction.

$$\Phi=\Sigma\Phi_i \quad \text{Formula (1)}$$

$$\Phi_i=\alpha\times L_1+\beta L_2 \quad \text{Formula (2)}$$

where α<0, β>0, Φ is the corrected rotated distance of the above image bearing member in which values $\Phi_i$ calculated with Formula (2) on all sheets (i=1 to N) having been passed through in prescribed period $T_a$ in the above previous printing job are totaled, $L_1$ is the length in the sub-scanning direction of each sheet (i-th sheet) having been passed through, and $L_2$ is the length in the sub-scanning direction of a non-sheet area produced between each of two sheets having been passed through.

α indicates the removable performance of lubricant K by sheet P, and since α relates to the surface properties of the paper sheet, further preferable result can be obtained if α is changed according to the type of sheet. β indicates the transferred amount of lubricant K, and since β relates to life of transfer material 91 or lubricant application section 93, environment or the like, Control unit CU, in the case where sheet size (in the main scanning direction) of the current printing job is larger than the sheet size of the last previous printing job, based on job information of the previous printing job executed in prescribed period $T_a$ going back to the current printing job prior to the execution of the second printing control mode shown in S104 of FIG. 7, calculates corrected rotated distance Φ of intermediate transfer body 6 at each area, in which the sheet passed area through which sheets are passed at the current printing job, is divided in the main scanning direction using Formulae (1) and (2). Further, control unit CU obtains maximum corrected rotated distance Φmax among each of calculated corrected rotated distances Φ.

Next, control unit CU obtains second predetermined value $R_2$ and reference number of times $C_r$ from calculated corrected rotated distance Φ of intermediate transfer body 6 using a correspondence table which was registered in advance and relates obtained corrected rotated distance Φmax of intermediate transfer body 6 to second predetermined value $R_2$ and reference number of times $C_r$.

Table 5 is an example of the correspondence table which relates corrected rotated distance Φ of intermediate transfer body 6 to second predetermined value $R_2$ and reference number of times $C_r$.

In this example, the factors are as follows: The type of sheet P is regular paper, the environment conditions are 20° C. and 50%, and α=−1 and β=2.

TABLE 5

| Maximum corrected rotated distance Φmax | Second predetermined value $R_2$ | Reference number of times $C_r$ |
|---|---|---|
| Φ < 150 m | 600 m | 1 |
| 150 m ≤ Φ < 330 m | 50 m | 1 |
| 330 m ≤ Φ | 50 m | 2 |

As shown in Table 5, in the case where a small size previous printing job is a small scale such that maximum corrected rotated distance Φmax of intermediate transfer body 6 rotated during the printing job is less than 150 m, first predetermined value $R_1$ is set to 600 m being equivalent to second predetermined value $R_2$, and reference number of times $C_r$ is set to 1.

Therefore, the additional return action of blade configuration executed in the second printing control mode doubles as the regular return action of blade configuration executed in the first printing control mode, and as a result, productivity of the printing job is not decreased. Further, in the case where the small size previous printing job is a small scale, the amount of lubricant K transferred to intermediate transfer body 6 is small, and therefore, the configuration of cleaning blade 802 does not reach a state of cleaning failure, and there is also no problem in terms of prevention of cleaning failure.

Table 6 shows timings (rotated distance L of intermediate transfer body 6) in which an additional return action of blade configuration and a regular return action of blade configuration are executed, in the case where the current printing job (a large size and the number of continuous printing corresponding to rotated distance L=1,500 m of intermediate transfer body 6) is carried out after the previous printing job (a small size) was carried out.

TABLE 6

| Maximum corrected rotated distance Φmax, | Execution timing of additional return action of blade configuration Based on second predetermined value $R_2$ | Execution timing of regular return action of blade configuration Based on first predetermined value $R_1$ |
|---|---|---|
| Φ < 150 m | 600 m | 600 m, 1200 m |
| 150 m ≤ Φ < 330 m | 50 m | 650 m, 1250 m |
| 330 m ≤ Φ | 50 m, 100 m | 700 m, 1300 m |

Underlines added to execution timings show that the additional return action of blade configuration double as the regular return action of blade configuration and the underlined are duplicated.

Next, control unit CU executes the additional return action of blade configuration according to flowcharts of FIGS. 7, 8, and 9, and after that, executes the regular return action of blade configuration. Therefore, since the additional return action of blade configuration is executed according to the scale of the last small size previous printing job, the decrease in productivity of the printing job can be reduced compared to the case where the additional return action of blade configuration is uniformly executed regardless of the scale.

Further, in the case where corrected rotated distance Φ of intermediate transfer body 6 in the last previous printing job is less than 150 m, the amount of applied lubricant K on intermediate transfer body 6 at the initiation of the current printing job is small, and therefore, without executing the additional return action of blade configuration, the configuration of cleaning blade 802 does not reach a state of cleaning failure, and there is also no problem in terms of prevention of cleaning failure.

According to the above embodiment of the present invention, even in the case where large size printing jobs are carried out after small size printing jobs were carried out, a cleaning failure which occurs in both side areas in the main scanning direction of a large size sheet of paper can be prevented, and thereby a highly reliable image forming apparatus having no printing failure can be obtained.

The image forming apparatus used in the above embodiments is image forming apparatus A in which a toner image is formed on intermediate transfer body 6, and the toner image is transferred onto sheet P using a transfer material on which a lubricant is applied, but the present invention also covers an image forming apparatus in which a toner image is formed on a photoreceptor as an image bearing member, and the toner image on the photoreceptor is transferred onto sheet P using a transfer material on which a lubricant is applied, and the apparatus also produces a similar effect.

Control unit CU of the above embodiments attains the additional return action of cleaning blade configuration by stopping the rotation of intermediate transfer body 6, but structures are also in the scope of the present invention, in which the additional return action of cleaning blade configuration is attained by rotating intermediate transfer body 6 in the opposite direction to the rotating direction after the stop of intermediate transfer body 6, or by releasing the pressure contact of cleaning blade 802 after the stop.

What is claimed is:

1. An image forming apparatus comprising:

an image forming section for forming a toner image on an image bearing member, a transfer section for transferring a toner image formed on the image bearing member onto a sheet of paper by pressure contact of the sheet of paper against the image bearing member with a transfer member, wherein the transfer section includes a lubricant applying section applying a lubricant to the transfer member;

a cleaning section being disposed downstream of the transfer section in a rotating direction of the image bearing member and removes residual toner on the image bearing member with a cleaning blade; and a control section for controlling a rotation of the image bearing member so as to carry out a return action of a blade configuration which stops or reverses the rotation of the image bearing member, when a rotation amount of the image bearing member which continuously rotates reaches a first predetermined value, wherein the control section additionally carries out the return action of the blade configuration when the rotation amount of the image bearing member reaches a second predetermined value which is smaller than the first predetermined value, in a case where a size in a main scanning direction of a sheet of paper being passed through in a current printing job is larger than a size in the main scanning direction of a sheet having been passed through in a previous printing job which was carried out just before the current printing job.

2. The image forming apparatus described in claim 1, wherein the second predetermined value is set based on minimum ratio Dmin of sheet passed among ratios D of sheet passed which was calculated using the following formula at each area in which a sheet passed area, through which sheets are passed at the current printing job, is divided in the main scanning direction, $$D=L_p/L_a,$$

where $L_a$ is a rotated distance of the image bearing member which rotated in a predetermined period in the previous printing job, and $L_p$ is a cumulative total length in a sub-scanning direction of the total sheets having been passed through during the predetermined period.

3. The image forming apparatus described in claim 1, wherein the second predetermined value is set based on a rotated amount of the image bearing member which rotated at the previous printing job just before the current printing job.

4. The image forming apparatus described in claim 1, wherein the second predetermined value is set based on maximum corrected rotated distance Φmax among corrected rotated distances Φ which is calculated using the following formula at each area in which a sheet passed area, through which sheets are passed at the current printing job, is divided in the main scanning direction, $$\Phi=\Sigma\Phi_i \qquad \text{Formula (1)}$$

$$\Phi_i=\alpha\times L_1+\beta\times L_2 \qquad \text{Formula (2)}$$

wherein, $\alpha<0$; $\beta>0$; Φ is the corrected rotated distance of the image bearing member in which calculated values $\Phi_i$ calculated by using Formula (2) were summed up on a total sheets (from i=1 to i=N) having been passed through in a predetermined period $T_a$ in the previous printing job; $L_1$ is a length in a sub-scanning direction of each sheet (the i-th sheet) having been passed through; and $L_2$ is a length in the sub-scanning direction of a non-sheet area produced between sheets having been passed through.

* * * * *